US005123708A

United States Patent [19]

Akesaka

[11] Patent Number: 5,123,708

[45] Date of Patent: Jun. 23, 1992

[54] SHIELD TUNNELLING MACHINE

[75] Inventor: Toshio Akesaka, Yokohama, Japan

[73] Assignee: Kabushiki Kaisha Iseki Kaihatsu Koki, Tokyo, Japan

[21] Appl. No.: 558,636

[22] Filed: Jul. 26, 1990

[30] Foreign Application Priority Data

Jul. 28, 1989 [JP] Japan ..... 1-194242

[51] Int. Cl.[5] ..... E21D 9/08

[52] U.S. Cl. ..... 299/56; 299/58; 405/141; 405/143

[58] Field of Search ..... 299/1, 33, 55, 56, 58; 405/138, 141, 143

[56] References Cited

U.S. PATENT DOCUMENTS

| | | | |
|---|---|---|---|
| 4,692,062 | 9/1987 | Akesaka | 405/141 |
| 4,846,606 | 7/1989 | Fukada | 405/141 X |
| 4,886,394 | 12/1989 | Akesaka | 405/141 |

FOREIGN PATENT DOCUMENTS

| | | | |
|---|---|---|---|
| 2607549 | 6/1988 | France | 405/141 |
| 6147956 | 6/1981 | Japan . | |
| 2024891 | 1/1980 | United Kingdom | 405/141 |
| 2079349 | 1/1982 | United Kingdom | 405/141 |

*Primary Examiner*—David J. Bagnell

*Attorney, Agent, or Firm*—Stoel Rives Boley Jones & Grey

[57] ABSTRACT

A shield tunnelling machine is provided. Such shield tunnelling machines include a tubular shield body; an excavating cutter assembly disposed on a front end of the body; a partition wall for defining the interior of the body into a front region and a rear region; a rotor having an outer diameter gradually increasing toward the rear; a drive mechanism for turning the rotor around a first axis and rotating the rotor around a second axis eccentric to the first axis; an annular member mounted to the rotor to be turned and rotated together with the rotor and extending around the first axis; and a discharging mechanism for discharging the excavated matter to the rear region.

9 Claims, 7 Drawing Sheets

SHIELD TUNNELLING MACHINE

BACKGROUND OF THE INVENTION

1. Field of the Invention

This invention relates to a shield tunnelling machine provided with a rotor turned around a first axis extending in axial direction of a shield body and rotated around a second axis eccentric to the first axis.

2. Description of the Prior Art

One shield tunnelling machine of this kind is disclosed in Japanese Patent Disclosure (KOKAI) No. 61-102999 and No. 63-189596. This excavating machine comprises a tubular shield body; a partition wall for defining the interior of the body into a front region and a rear region; a rotor disposed in the front region so as to permit the turning motion around an axis of the body and the rotational motion around an axis displaced from the axis of the body and having an outer surface gradually increasing in diameter toward the rear; a drive mechanism for turning and rotating the rotor; an excavating cutter assembly connected to the rotor so as to be turned and rotated together with the rotor; and a discharging mechanism for discharging the excavated matter from the front region to the rear region.

The front region has a first chamber having a diameter gradually decreasing toward the rear that receives the matter excavated by the cutter assembly and a second chamber communicating with a rear portion of the first chamber to receive the excavated matter from the first chamber and extending around the axis of the body. The rotor has an outer diameter gradually increasing toward the rear and is disposed in the first chamber.

In excavation, the rotor and the cutter assembly are turned around the axis of the body and rotated around the axis eccentric to the axis of the body by the drive mechanism. In this manner, the cutter assembly excavates a facing, and the rotor serves as a machine for compacting and crushing the excavated matter in cooperation with the body. During excavation, the first and second chambers are filled with the excavated matter, thereby preventing collapse of the facing.

In this known tunnelling machine, however, pressurized muddy water is supplied from the rear region to the second chamber. As the muddy water and the excavated matter in the second chamber are discharged to the rear region, the problem of separation of discharged muddy water and excavated matter prior to water disposal exists.

In order to solve the problem when a discharging mechanism is provided with a screw conveyor to excavate ground containing a large quantity of highly viscous matter, like a silt layer, the excavated matter is particularly prevented from shifting through the second chamber toward the discharging mechanism due to the viscosity of the excavated matter, so that the excavated matter is not discharged to make continued excavation difficult.

SUMMARY OF THE INVENTION

It is an object of the present invention to provide a shield tunnelling machine capable of excavating ground containing a large quantity of highly viscous matter without using muddy water.

A shield tunnelling machine according to the present invention includes a tubular shield body; an excavating cutter assembly disposed on a front end of the body; a partition wall for defining the interior of the body into a front region and a rear region behind the front region, the front region having a first chamber for receiving the matter excavated by the cutter assembly and a second chamber communicating with a rear portion of the first chamber to receive the excavated matter from the first chamber, the second chamber extending around an axis of the body; a rotor disposed in the first chamber and having an outer diameter gradually increasing toward the rear; a drive mechanism for turning or revolving the rotor around a first axis extending in the longitudinal direction of the body and rotating the rotor around a second axis eccentric to the first axis; an annular member mounted to the rotor so as to be turned and rotated together with the rotor in the second chamber and extending around the axis of the body; and a mechanism for discharging the excavating matter received in the second chamber from a bottom of the second chamber to the rear region.

Due to earth pressure and thrust of the tunnelling machine, the matter excavated by the cutter assembly is received in the first chamber; moved in the first chamber toward the second chamber; shifted from the first chamber to the second chamber; and then moved toward the lower portion of the second chamber. The first chamber is filled with the excavated matter during the excavation, so that facing collapse is prevented.

During excavation the rotor and the annular member are turned or revolved in the first and second chambers, respectively. As a result, even if the first and second chambers are filled with excavated matter, space for receiving excavated matter is formed in each of the first and second chambers due to the displacement of the rotor and the annular member relative to the shield body.

Consequently, even if the facing has a silt layer or like layer containing a large quantity of highly viscous matter, the excavated matter is mainly received in the first chamber to fill the space resulting from the displacement of the rotor and is then moved in the first chamber toward the second chamber. The excavated matter in the first chamber is forced into the second chamber to fill the space resulting from the displacement of the annular member. The excavated matter in the second chamber is shifted toward the lower portion of the second chamber and forced out to the lower portion of the second chamber, i.e., a discharging portion, when the annular member is displaced downward. The excavated matter in the lower portion of the second chamber is finally discharged from the second chamber by the discharging means.

According to the present invention, ground containing a large quantity of highly viscous matter may be excavated without using muddy water.

A plurality of blades are preferably mounted to the outer surface of the annular member at angular intervals t extend in the radial and longitudinal directions of the shield body. Since the blades are turned and rotated in the second chamber together with the annular member, even excavated matter with high viscosity is surely shifted to the lower portion of the second chamber with the turning and rotational motions of the blades, so that excavated matter in the second chamber is surely discharged.

The second chamber preferably has an annular upper area communicating with the first chamber to receive excavated matter from the first chamber and extending around the axis of the body and a lower area communicating with a bottom of the upper area to receive excavated matter from the upper area and to serve as the lower portion of the second chamber. As a result, even excavated matter with high viscosity in the upper area is surely shifted toward the lower area with the turning and rotational motions of the annular member and forced from the upper area to the lower area when the annular member is displaced downward, so that the excavated matter received in the lower area is surely discharged by the discharging means.

As the discharging mechanism, a screw conveyor type mechanism may be used. Such a screw conveyor mechanism is provided with a casing opened to the lower area of the second chamber and to a rear end of the casing and extending in the body from the partition wall to the rear thereof; a screw conveyor extending in the casing from the lower area toward a rear end opening of the casing; a rotary mechanism for rotating the screw conveyor; and a valve mechanism for opening and closing the rear end opening of the casing. The discharging mechanism is structured such that the rear end opening of the casing is opened by the valve mechanism when pressure in the casing exceeds a predetermined value.

If the cutter assembly is mounted to the front end of the rotor, the cutter assembly is turned and rotated together with the rotor. Also, a cutter assembly provided with a plurality of cutter bits can be used and disposed such that a cutting edge of each cutter bit is directed toward the center of the body.

The drive mechanism can be provided with a crankshaft supported by the partition wall, rotatable around the first axis, and having an eccentric portion provided at the side of the first chamber, the eccentric portion rotatably supporting the rotor; a rotary mechanism for rotating the crankshaft; an external gear mounted to the partition wall to extend around the first axis; and an internal gear partially meshing with the external gear and mounted to at least one of the rotor and the annular member to extend around the second axis.

The shield body can be provided with a tubular head portion having the front region; a tubular tail portion following the head portion; a plurality of jacks having two connecting portions relatively displaced in the axial direction of the tail portion; and a connecting body for interconnecting the head portion and the tail portion, such that the connecting body permits the head portion and the tail portion to swing and prevents the head portion and the tail portion from relatively displacing in the axial direction of the tail portion. In this case, each of the jacks is connected at one connecting portion to the head portion, while being connected at the other connecting portion to the tail portion. Also, the jacks and the connecting body are disposed around the axis of the tail portion at angular intervals.

The shield tunnelling machine according to the present invention further preferably includes an indicator for indicating the direction and amount of relative deviation between the head portion and the tail portion. As the indicator, a known indicator, with a dial plate fixed to one of the head portion and the tail portion and a pointer fixed to the other of the head portion and the tail portion and confronting the dial plate, may be used. When the indicator is disposed close to the connecting body, the amount of relative displacement in the direction of the dial plate and the pointer which move close to and away from each other due to the relative deviation between the head portion and the tail portion is reduced, so that the amount of deviation of the head portion relative to the tail portion is accurately indicated.

Another shield tunnelling machine according to the present invention includes a tubular shield body; an excavating cutter assembly disposed on a front end of the body; a partition wall for defining the interior of the body into a front region and a rear region behind the front region, the front region having a first chamber for receiving the matter excavated by the cutter assembly and a second chamber communicating to a rear portion of the first chamber to receive the excavated matter in the first chamber, the second chamber extending around an axis of the body; a rotor disposed in the first chamber and having an outer diameter gradually increasing toward the rear; a drive mechanism for turning the rotor around a first axis extending in the longitudinal direction of the body and rotating the rotor around a second axis eccentric to the first axis; a plurality of blades mounted to the rotor around the axis of the body at angular intervals to extend in the radial and longitudinal directions of the body in the second chamber; and a mechanism for discharging the excavated matter received in the second chamber from a lower portion of the second chamber to the rear region.

In another shield tunnelling machine, the blades are turned and rotated in the second chamber with the turning and rotational motions of the rotor. In this manner, the excavated matter in the second chamber is shifted to the lower portion of the second chamber by the turning and rotational motions of the blades and discharged to the rear region by the discharging means.

In another shield tunnelling machine, an annular member extending in the second chamber around the axis of the body is mounted to the rotor so that the annular member is rotated and turned together with the rotor. The blades are mounted to the outer surface of the annular member. In this manner, the excavated matter in the second chamber is forced downward in the second chamber by the turning motion of the annular member.

BRIEF DESCRIPTION OF THE DRAWINGS

The foregoing and other objects and features of the invention will become apparent from the following description of preferred embodiments of the invention with reference to the accompanying drawings, in which.

DETAILED DESCRIPTION OF THE PREFERRED EMBODIMENTS

Figure 1:
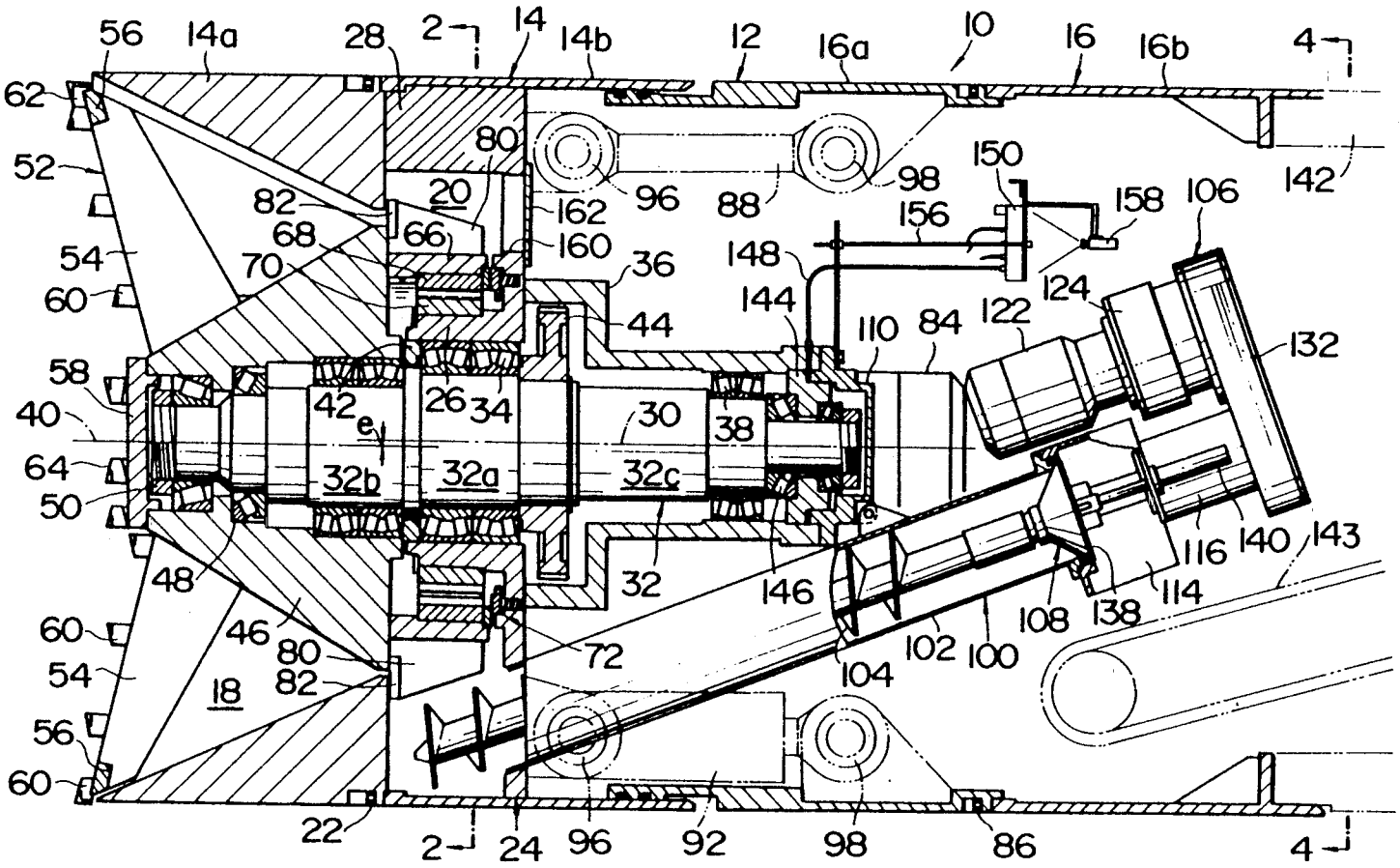
FIG. 1 is a sectional view showing an embodiment of a shield tunnelling machine according to the present invention.

Referring to FIG. 1, a shield tunnelling machine 10 comprises a tubular shield body 12. Shield body 12 is provided with a tubular head portion 14 and a tail portion 16 following the head portion. A front end of tail portion 16 is formed into a small-diameter portion and swingably received within a rear end of head portion 14.

Head portion 14 is divided into a first tubular portion 14*a* having a first chamber 18 of a truncated conical shape having an inner diameter gradually decreasing toward the rear and a second tubular portion 14*b* defining a second chamber 20 following the rear of first chamber 18 and having an inner diameter larger than that of a rear end of first chamber 18. First and second tubular portions 14*a* and 14*b* are separably jointed to each other with a plurality of bolts 22, such that a rear end of first tubular portion 14*b* are butted against each other.

First and second chambers 18 and 20 constitute a front region maintained at high pressure to prevent facing collapse and are separated from a rear region under atmospheric pressure by a partition wall 24 mounted to second tubular portion 14*b*. The inner diameter of first chamber 18 may be approximately equalized. In that case, the inner diameter of first chamber 18 may be approximately equal to that of second chamber 20, and the inner diameter of second chamber 20 may be smaller than that of first chamber 18.

Figure 2:
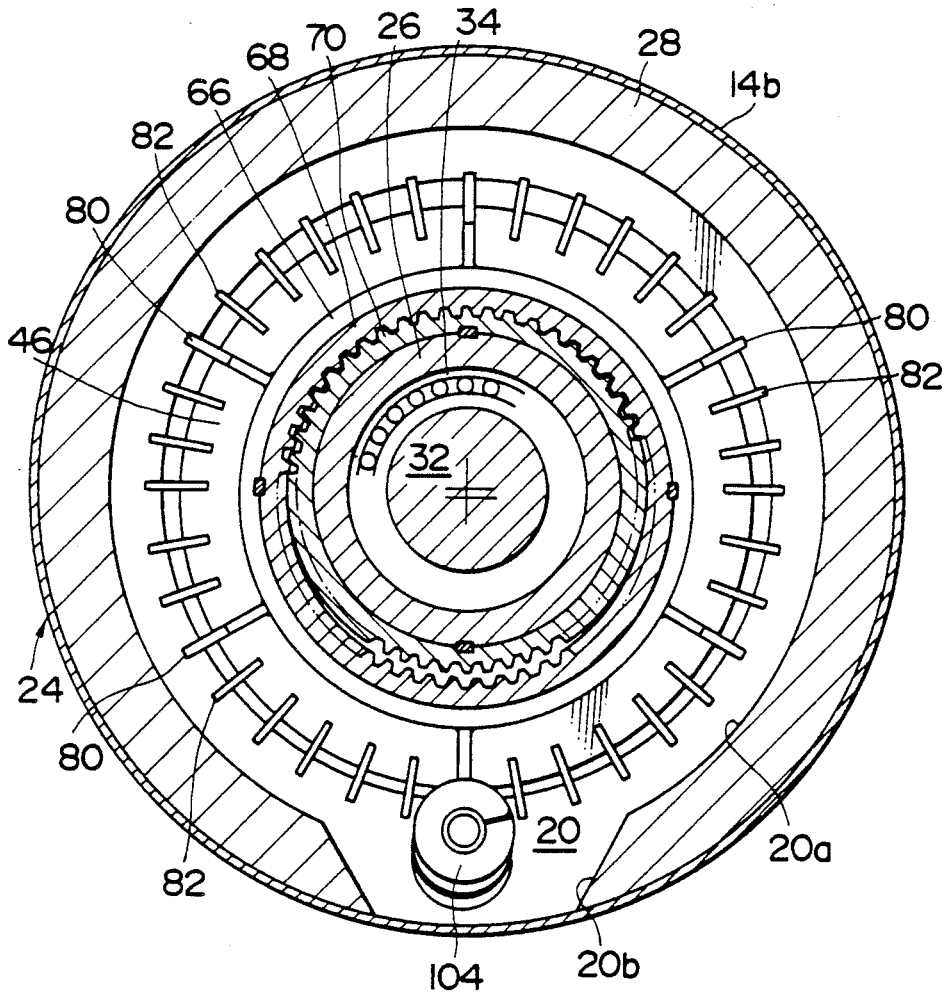
FIG. 2 is a sectional view taken along a line 2—2 in FIG. 1.

Partition wall 24 has a central portion provided with a boss portion 26 projecting toward second chamber 20 and an outer peripheral portion provided with a projection 28 projecting toward second chamber 20. As shown in FIG. 2, projection 28 takes the shape of a ring having a cut-out lower portion. Thus, second chamber 20 has an annular upper area 20*a* extending around boss portion 26 and a lower area 20*b* communicating with a bottom portion of upper area 20*a* to receive excavated matter from upper area 20*a*. Upper area 20*a* communicates with first chamber 18 to receive excavated matter from first chamber 18.

Boss portion 26 of partition wall 24 supports a crankshaft 32 extending toward an axis 30 of body 12, so that crankshaft 32 is rotated around axis 30 through a plurality of bearings 34. Crankshaft 32 is provided with a supported portion 32*a* supported by boss portion 26, an eccentric portion 32*b* extending forward from supported portion 32*a* and an extension portion 32*c* extending rearward from supported portion 32*a*. Extension portion 32*c* is supported, through a plurality of bearings 38, on a bracket 36 mounted to partition wall 24.

Axes of supported portion 32*a* and of extension portion 32*c* are coincident with axis 30 of shield body 12, whereas an axis 40 of eccentric portion 32*b* is eccentric to axis 30 by a distance "e." Each bearing 34 is prevented from shifting toward axis 30 by a bearing holder 42 fitted to a front end of boss portion 26 and a gear 44 mounted to an end of extension portion 32*c* at side of supported portion 32*a*.

Eccentric portion 32*b* rotatably supports a rotor 46 disposed inside first chamber 18 through a plurality of bearings 48. Rotor 46 has an outer surface gradually increasing in diameter from front to rear. As a result, first chamber 18 is limited in shape to a substantially V-like sectional shape, converging toward second chamber 20. Rotor 46 is prevented from disengaging from 32 by a nut 50 screwed onto a front end of crankshaft 32.

As shown in FIGS. 1 and 2, the outer diameter of a rear end of rotor 46 is selectively defined to permit first and second chambers 18 and 20 to communicate completely and annularly around axis 30.

Figure 3:
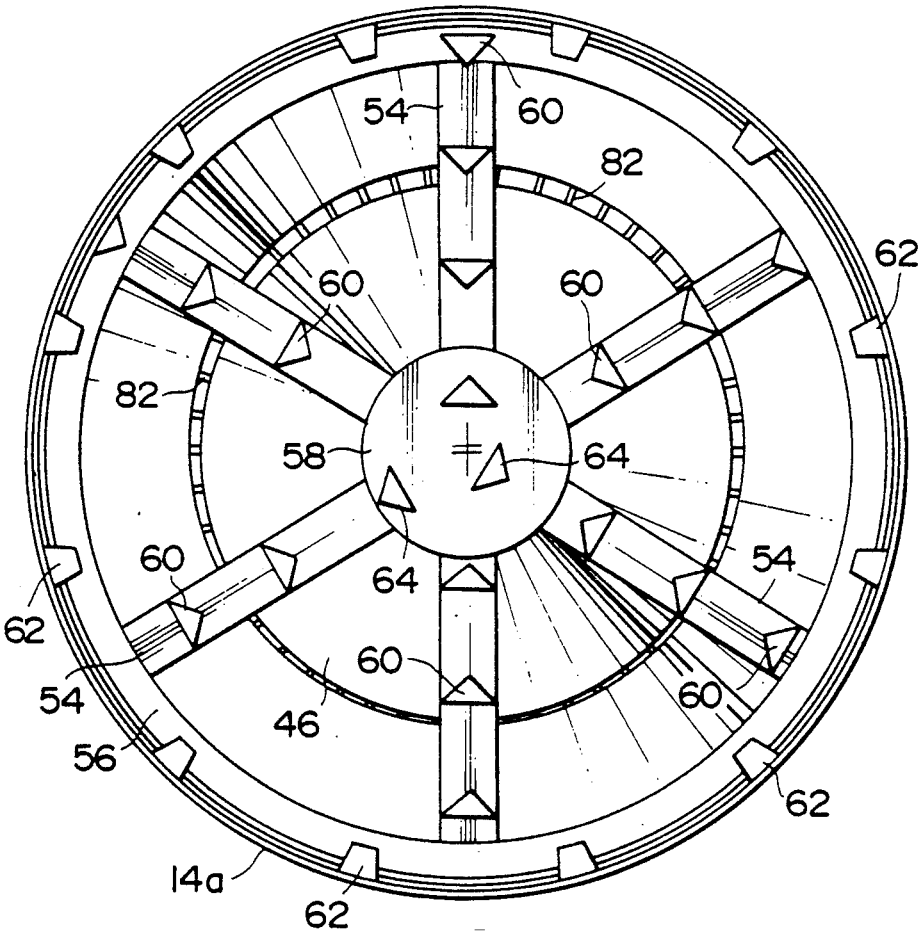
FIG. 3 is a left side view of the embodiment of the present invention shown in FIG. 1.

A cutter assembly 52 is fixedly attached to a front end of rotor 46. As shown in FIGS. 1 and 3, cutter assembly 52 is provided with a plurality of arms 54 extending from rotor 46 in radial direction of body 12; a ring 56 for interconnecting front ends of adjacent arms 54; a disk-like cap 58 mounted to front end of rotor 46; a plurality of cutter bits 60 fixed to arm 54; a plurality of cutter bits 62 mounted to ring 56; and a plurality of cutter bits 64 mounted to cap 58.

Each cutter bit 60 mounted to arms 54 is disposed such that its cutting edge is directed toward the rotary center of cutter assembly 52, that is, directed inward, while its cutting edge is positioned behind the cutting edge of the cutter bit disposed outside the first-mentioned cutter bit. On the other hand, each cutter bit 62 disposed on the outermost periphery has an inward cutting edge directed toward the rotary center of cutter assembly 52 and an outward cutting edge directed in the opposite direction. Also, each cutter bit 64 mounted to cap 58 is disposed such that its cutting edge is directed outward in the radial direction.

As shown in FIGS. 1 and 2, an annular member 66 is mounted to the rear end of rotor 46. Annular member 66 is disposed in second chamber 20, extends around boss portion 26, and is spaced apart from boss portion 26. Annular member 66 may be a portion of rotor 46.

An internal gear 68, centered around axis 30, is mounted to the inside of annular member 66. An external gear 70 meshing with gear 68 is mounted to boss portion 26 and centered around axis 30. Tooth tip radius of gears 68 and 70 is selectively defined to permit both gears to partially mesh with each other at a portion in the circumferential direction.

Internal gear 68 may be integral with annular member 66. Also, internal gear 68 may be directly mounted to rotor 46, instead of fixing internal gear 68 to annular member 66. Further, external gear 70 may be mounted to boss portion 26, and internal gear 68 may be mounted to rotor 46.

Figure 5:
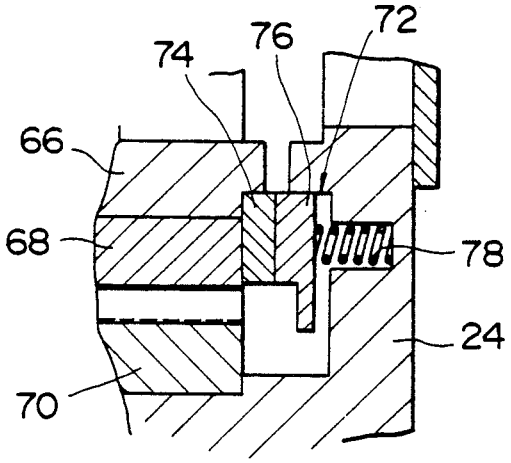
FIG. 5 is an enlarged-scale sectional view showing a portion of a mechanical seal of an embodiment of the present invention.
Figure 6:
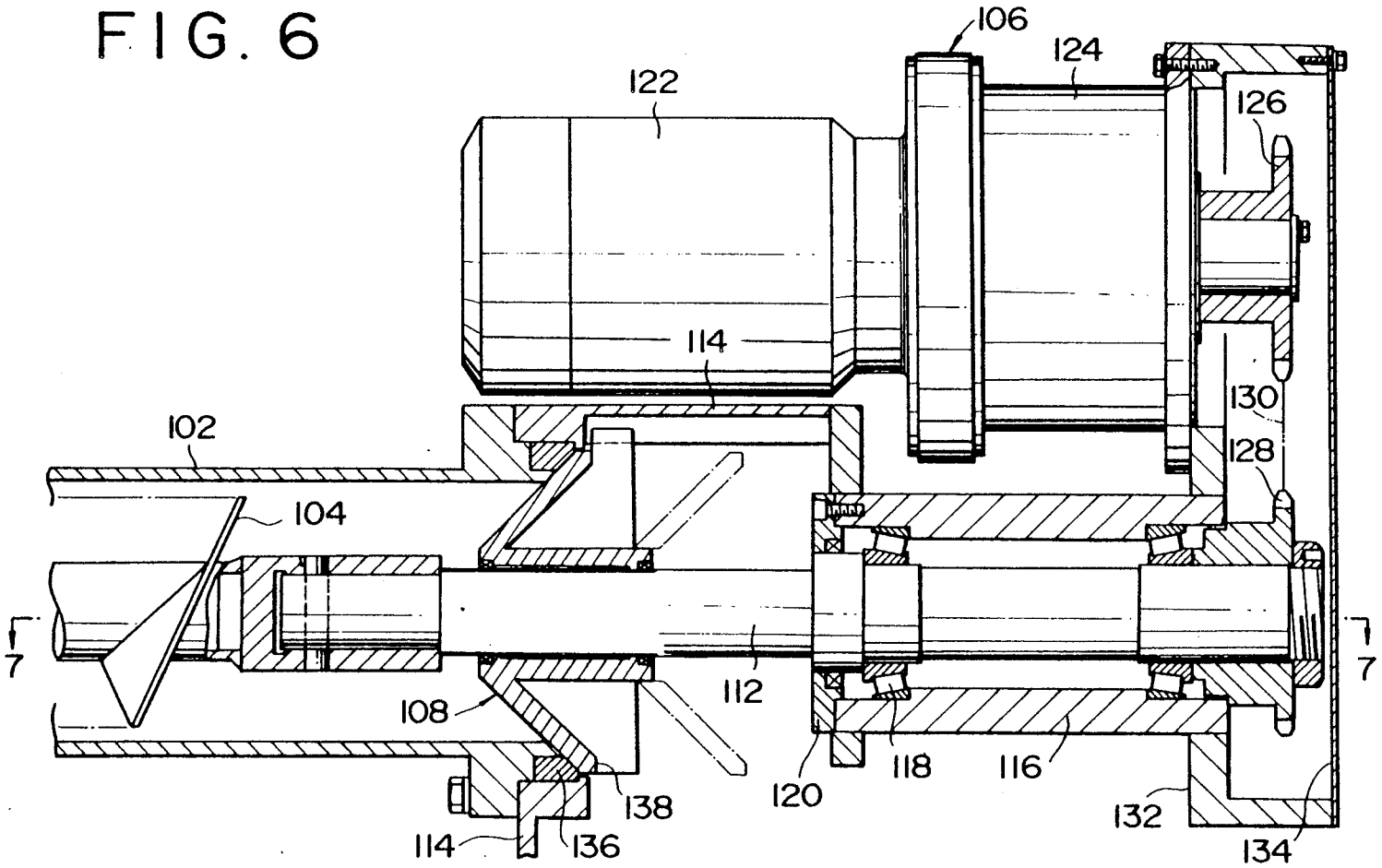
FIG. 6 is an enlarged-scale sectional view showing a portion of a discharging mechanism of the present invention.
Figure 7:
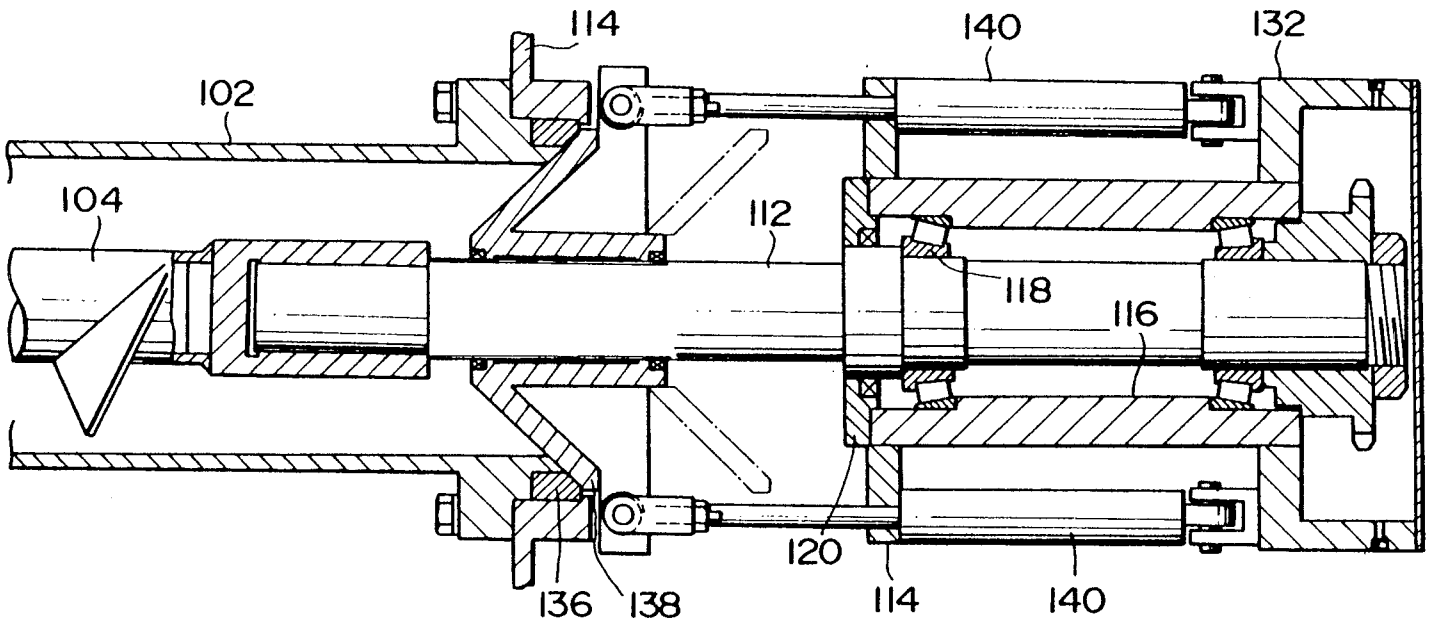
FIG. 7 is a sectional view taken along a line 7—7 in FIG. 6.

A portion between partition wall 24 and annular member 66 is maintained in liquid-tightness by a mechanical seal 72. As shown in FIGS. 1 and 5, mechanical seal 72 is provided with a ring 74 immovably disposed in a recess formed on the rear end face of annular member 66 and that of internal gear 68 and a ring 76 disposed inside an annular projection formed on partition wall 24 at the second chamber side, so that ring 76 is immovable in the diametral direction of body 12. Ring 76 is pressed against ring 74 by the action of a plurality of springs 78 disposed on partition wall 24. Each spring 78 is received in a recess formed on partition wall 24.

As shown in FIGS. 1 and 2, a plurality of blades 80 are mounted to the outer peripheral surface of annular member 66 at equal angular intervals, and a plurality of rod-like members 82 are mounted to the rear end face of rotor 46 at equal angular intervals. Each blade 80 extends back and forth and also extends from annular member 66 outward in the radial direction of body 12 to a position beyond a communicating portion between first and second chambers 18 and 20. On the other hand, each rod-like member 82 extends from rotor 46 outward in the radial direction of body 12 to a position beyond the communicating portion between first and second chambers 18 and 20. Each blade 80 may be directly mounted to rotor 46.

Crankshaft 32 is rotated through gear 44 by a pair of rotary mechanisms 84 mounted to bracket 36. Since rotor 46 is revolved around axis 30, cutter assembly 52, annular member 66, internal gear 68, blades 80 and rod-like members 82 are revolved around axis 30, respectively.

When internal gear 68 is revolved, a meshed portion between internal gear 68 and external gear 70 varies with the revolving of internal gear 68, so that internal gear 68 is rotated around axis 40 relative to external gear 70. In this manner, rotor 46, cutter assembly 52, annular member 66, blades 80 and rod-like members 82 are not only revolved around axis 30, but also rotated around axis 40.

In the illustrated embodiment, the rotational direction of rotor 46, cutter assembly 52, annular member 66, internal gear 68, blades 80 and rod-like members 82 is identical to the revolving direction, since internal gear 68 is mounted to the side of rotor 46, and external gear 70 is mounted to the side of partition wall 24. However, if internal gear 68 is mounted to the side of partition wall 24, and external gear 70 is mounted to the side of rotor 46, the rotational direction is opposite to the revolving direction.

The ratio of revolving motion to rotational motion of rotor 46, cutter assembly 52, annular member 66, internal gear 68, blades 80 and rod-like members 82 is determined by the number of teeth of gears 68 and 70. If the difference in number of teeth between gears 68 and 70 is small, the number of revolutions per rotation is increased.

In the illustrated embodiment, tail portion 16 is also divided into first and second tubular portions **16*a* and 16*b* separably butted and jointed to each other with a plurality of bolts 86**.

Figure 4:
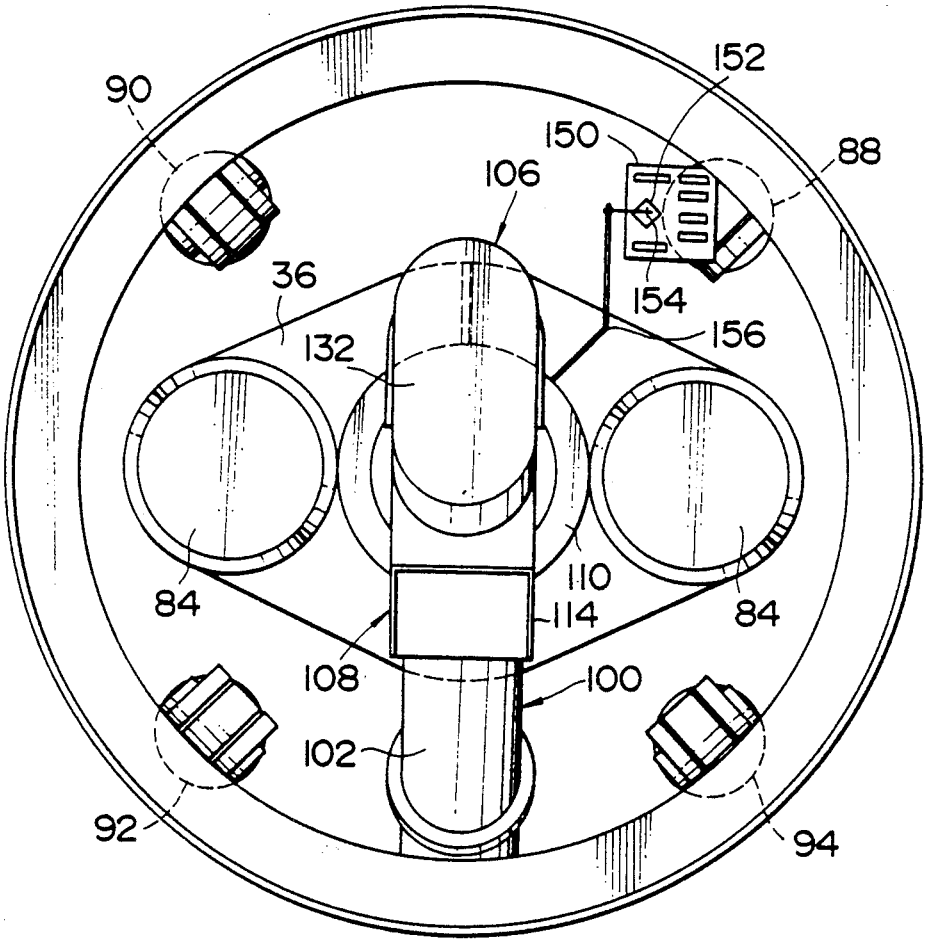
FIG. 4 is a sectional view taken along a line 4—4 in FIG. 1.

As shown in FIGS. 1 and 4, head portion 14 and tail portion 16 are swingably interconnected through a rod 88 and three jacks 90, 92 and 94 for correcting the direction of head portion 14 relative to tail portion 16, thereby correcting the direction of excavation. Each of jacks 90, 92 and 94 is a double-acting jack capable of both pushing and pulling actions.

One end of rod 88 and cylinders of jacks 90, 92 and 94 are respectively connected to head portion 14 through a joint 96. The other end of rod 88 and the piston rods of jacks 90, 92 and 94 are respectively connected to tail portion 16 through a joint 98. The cylinders of jacks 90, 92 and 94 may be connected to tail portion 16, and the piston rods of jacks 90, 92 and 94 may be connected to head portion 14.

Joints 96 and 98 are preferably universal joints which permit connected members to angularly rotate about two axes orthogonal to the axis of rod 88 or the axes of jacks 90, 92 and 94. A joint disclosed in Japanese Patent Publication No. 61-47956, for example, is an exemplary joint 96 or 98 useful in the present invention.

The axes of rod 88 and jacks 90, 92 and 94 are disposed along an imaginary circle around axis 30 at equal angular intervals (i.e., 90 degrees). In the illustrated embodiment, rod 88 and jacks 90, 92 and 94 are so disposed that rod 88 and jack 90 are located above jacks 94 and 92, respectively. Rod 88 and jacks 90, 92 and 94 may be disposed, such that rod 88 occupies the position of jack 90, 92 or 94.

In excavation direction correction, when jacks 92 and 94 are simultaneously contracted, head portion 14 is directed downward relative to tail portion 16 with rod 88 and jack 90 as the center. When jacks 92 and 94 are simultaneously extended, head portion 14 is directed upward relative to portion 16 with rod 88 and jack 90 as the center. When jacks 90 and 92 are simultaneously contracted, head portion 14 is directed leftward relative to tail portion 16 with rod 88 and jack 94 as the center. When the jacks 90 and 92 are simultaneously extended, head portion 14 is directed rightward relative to tail portion 16 with rod 88 and jack 94 as the center.

As shown in FIGS. 1, 4, 6 and 7, a discharging mechanism 100 for discharging excavated matter from second chamber 20 is provided with a casing 102 opening to the lower portion of second chamber 20, i.e., to lower area **20*b* and extending from partition wall 24 rearward within body 12; a screw conveyor 104 extending in casing 102 toward the rear end opening of casing 102; a drive mechanism 106 for rotating screw conveyor 104; and a valve mechanism 108 for opening and closing the rear end opening of casing 102**.

A front end of screw conveyor 104 reaches lower area **20*b* of second chamber 20. Screw conveyor 104 is supported on its front end by partition wall 24, while being supported on its rear end by a cap 110 mounted to bracket 36. A shaft 112 extending from the rear end of screw conveyor 104 rearward is connected to screw conveyor 104**.

Shaft 112 extends through a chute 114 mounted to the rear end of casing 102 and a sleeve 116 mounted to a rear end of chute 114. Shaft 112 is rotatably supported by sleeve 116 through a plurality of bearings 118. Chute 114 is opened to the underside and to the side of casing 102, so that chute 114 receives excavated matter discharged by screw conveyor 104 from casing 102 to drop the excavated matter downward. A front end opening of sleeve 116 is closed by a cap 120.

The rotational speed of a rotary source 122 is reduced by a reduction gear 124. Drive mechanism 106 transmits the resultant rotation of rotary source 122 from a sprocket 126 mounted to an output shaft of reduction gear 124 to a sprocket 128 mounted to a rear end of shaft 112 through a chain 130 to rotate screw conveyor 104. Drive mechanism 106 is supported by a case 132 mounted to sleeve 116. Case 132 has a rearward opening which is closed by a plate 134.

Valve mechanism 108 is provided with a valve seat 136 mounted to the rear end of casing 102 by chute 114; a valve body 138 slidably supported by shaft 112; and a pair of cylinder mechanisms 140 for pressing valve body 138 toward valve seat 136. Valve body 138 has an outer surface that gradually increases in diameter toward the rear.

In excavation, tunnelling machine 10 is advanced by a basic thrusting device installed in a shaft (not shown) together with a pipe 142 following the rear of shield body 12. When tunnelling machine 10 is advanced, crankshaft 32 is rotated by rotary mechanism 84, so that rotor 46, cutter assembly 52, annular member 66, internal gear 68, blades 80 and rod-like members 82 are revolved around axis 30, while being rotated around axis 40.

Thus, the facing is excavated by the revolving motion and rotational motion of cutter assembly 52, and first and second chambers 18 and 20 are filled with excavated matter, so that the facing collapse is prevented.

However, since rotor 46 and annular member 66 are revolved during excavation, a space is defined inside each of first and second chambers 18 and 20 as a result of the displacement of rotor 46 and annular member 66 relative to body 12, even if first and second chambers 18 and 20 are filled with excavated matter. As a result, excavated matter is transferred to first chamber 18 by the advancing force of excavating machine 10 and the earth pressure of the facing to fill the space resulting from the displacement of rotor 46 and is then shifted through first chamber 18 toward second chamber 20. Also, excavated matter within first chamber 18 is forced out to upper area 20*a* of second chamber 20 to fill the space resulting from the displacement of annular member 66.

The excavated matter within second chamber 20 is repetitively pressed radially outward within upper area 20*a* of second chamber 20 along with the revolving motion of annular member 66, while being shifted gradually downward through upper area 20*a*, i.e., to an upper portion of lower area 20*b* along with the rotational motion of annular member 66 and blades 80. Consequently, excavated matter is forcibly depressed to lower area 20*b* when annular member 66 is displaced downward along with its revolving motion.

The excavated matter within lower area 20*b* is conveyed toward valve mechanism 108 by screw conveyor 104 of discharging mechanism 100. However, since the rear end of casing 102 is closed by valve mechanism 108, excavated matter stays within casing 102. In this manner, facing collapse is more surely prevented.

When valve body 138 of valve mechanism 108 is pushed rearwardly by excavated matter within casing 102 against the force of cylinder mechanism 140, valve body 138 is separated from valve seat 136, so that excavated matter within casing 102 is pushed out of casing 102 to chute 114. The excavated matter dropping from chute 114 is received by a belt conveyor 143 and conveyed rearwardly by belt conveyor 143.

The earth pressure of the facing mainly acts on first tubular portion 14*a* and rotor 46. The earth pressure acting on rotor 46 acts on an earth pressure detector 144 through crankshaft 32. Earth pressure detector 144 is disposed on extension portion 32*c* of crankshaft 32 through a plurality of bearings 146 and defines an earth pressure detecting chamber together with the inner face of the rear end of bracket 36 and the front end face of cap 110. The earth pressure detecting chamber transmits the pressure acting on fluid received in the earth pressure detecting chamber to an indicator 150 through a pipe 148. In this manner, earth pressure is indicated visually on an indicating portion for an earth pressure cell of indicator 150.

As shown in FIG. 4, indicator 150 is provided with a dial plate 152 for indicating the direction and amount of deviation of head portion 14 relative to tail portion 16 and a pointer 154 confronting the dial plate, in addition to instruments such as an earth pressure cell and an oil pressure gauge. Dial plate 152 may be a known dial plate having a plurality of parallels and meridians. Pointer 154 may be a known cross-shaped pointer.

Indicator 150 is mounted on tail portion 16 such that the indicating surface of indicator 150 is located in the rear. When head portion 14 is in its neutral position relative to tail portion 16, that is, when head portion 14 is not deviated from tail portion 16, pointer 154 is mounted to cap 110 with a fixture 156 such that pointer 154 indicates the reference point, i.e., 0 of dial plate 152.

When head portion 14 is deviated relative to tail portion 16 by the direction correcting device consisting of rod 88 and jacks 90, 92 and 94, pointer 154 is displaced relative to dial plate 152 in the direction corresponding to the deviation by a distance corresponding to the amount of deviation. The positional relation between dial plate 152 and pointer 154 is displayed on a monitor (not shown) by a television camera 158 picking up the indicating surface of indicator 150. Television camera 158 is also mounted to tail portion 16.

Indicator 150 including dial plate 152 and pointer 154 is preferably disposed close to rod 88 in a plane orthogonal to axis 30. Since the displacement of pointer 154, in the direction of dial plate 152 and pointer 154 which move close to and away from each other, is small, the amount of deviation of head portion 14 relative to tail portion 16 is accurately indicated. Also, when indicator 150 is disposed on a fulcrum of relative swing of head portion 14 and tail portion 16, e.g., on center of a circular arc around the center in the axial direction of rod 88, the displacement of pointer 154, in the direction of dial plate 152 and pointer 154 which move close to and away from each other is smaller, so that the amount of deviation of head portion 14 relative to tail portion 16 is more accurately indicated. Tunnelling machine 10 has a hole 160 formed in an upper portion of partition wall 24. Hole 160 is closed by a plate 162 when the excavated matter is discharged by discharging mechanism 100. Hole 160 is utilized when muddy water is used as a discharging means. When the muddy water is used as the discharging means, discharging mechanism 100 and plate 162 are removed, and a pressurized muddy water supplying pipe is connected to hole 160, and a muddy water draining pipe is connected in place of discharging mechanism 100, i.e., communicated with lower area 20*b*.

What is claimed is:

1. A shield tunnelling machine, comprising:

a tubular shield body having a front end and a rear end;

an excavating cutter assembly disposed on said front end of said body;

a partition wall for defining the interior of said body into a front region and a rear region behind said front region, said front region having a first chamber for receiving matter excavated by said cutter assembly and a second chamber communicating with a rear portion of said first chamber to receive the excavated matter from said first chamber, said second chamber extending around an axis of said body;

a rotor disposed in said first chamber and having an outer diameter gradually increasing toward the rear end;

a drive mechanism for turning said rotor around a first axis extending in the longitudinal direction of said body and rotating said rotor around a second axis eccentric to said first axis;

an annular member mounted to said rotor to be turned and rotated together with said rotor in said second chamber and extending around the axis of said body;

a discharging mechanism for discharging excavated matter received in said second chamber from a lower portion of said second chamber to said rear region; and a plurality of blades mounted on an outer surface of said annular member at angular intervals to extend in radial and longitudinal directions of said body.

2. A shield tunnelling machine according to claim 1, wherein said second chamber has an annular upper area communicating with said first chamber to receive excavated matter from said first chamber and extending around the axis of said body and a lower area communicating with a bottom of said upper area to receive excavated matter from said upper area and serving as a lower portion of said second chamber, and wherein said discharging mechanism discharges excavated matter received in said lower area.

3. A shield tunnelling machine according to claim 2, wherein said discharging mechanism is provided with a casing opened to said lower area and opened at a rear end of said casing and extending in said body from said partition wall toward the rear of said body; a screw conveyor extending in said casing from said lower area toward a rear end opening of said casing; a rotary mechanism for rotating said screw conveyor; and a valve mechanism for opening and closing said rear end opening, said valve mechanism opening when pressure in said casing exceeds a predetermined value.

4. A shield tunnelling machine according to claim 1, wherein said cutter assembly is mounted to a front end of said rotor and provided with a plurality of cutter bits having cutting edges directed toward the center of said body.

5. A shield tunnelling machine according to claim 1, wherein said drive mechanism is provided with a crankshaft supported by said partition wall, rotatable around said first axis, and having an eccentric portion provided at the side of said first chamber, said eccentric portion rotatably supporting said rotor; a rotary mechanism for rotating said crankshaft; an external gear mounted to said partition wall to extend around said first axis; and an internal gear partially meshing with said external gear and mounted to at least one of said rotor and said annular member to extend around said second axis.

6. A shield tunnelling machine according to claim 1, wherein said shield body is provided with a tubular head portion having said front region; a tubular tail portion following said head portion; a plurality of jacks having two connecting portions relatively displaced in the axial direction of said tail portion; and a connecting body for interconnecting said head portion and said tail portion, permitting said head portion and said tail portion to swing and preventing said head portion and said tail portion from relatively displacing in the axial direction of said tail portion, each of said jacks being connected at one connecting portion to said head portion, while being connected at the other connecting portion to said tail portion, and said jacks and said connecting body being disposed around the axis of said tail portion at angular intervals.

7. A shield tunnelling machine according to claim 6, further comprising an indicator disposed close to said connecting body and indicating the direction and amount of relative deviation between said head portion and said tail portion, said indicator including a dial plate fixed to one of said head portion and said tail portion and a pointer fixed to the other of said head portion and said tail portion and confronting said dial plate.

8. A shield tunnelling machine, comprising:

a tubular shield body having a front end and a rear end;

an excavating cutter assembly disposed on said front end of said body;

a partition wall for defining the interior of said body into a front region and a rear region behind said front region, said front region having a first chamber for receiving matter excavated by said cutter assembly and a second chamber communicating with a rear portion of said first chamber to receive the excavated matter in said first chamber, said second chamber extending around an axis of said body;

a rotor disposed in said first chamber and having an outer diameter gradually increasing toward the rear end;

a drive mechanism for turning said rotor around a first axis extending in the longitudinal direction of said body and rotating said rotor around a second axis eccentric to said first axis;

a plurality of blades mounted to said rotor around the axis of said body at angular intervals to extend in the radial and longitudinal directions of said body in said second chamber; and a discharging mechanism for discharging excavated matter received in said second chamber from a lower portion of said second chamber to said rear region.

9. A shield tunnelling machine according to claim 8, further comprising an annular member mounted to said rotor to be turned and rotated together with said rotor in said second chamber and extending around the axis of said body.

* * * * *

UNITED STATES PATENT AND TRADEMARK OFFICE

CERTIFICATE OF CORRECTION

PATENT NO. : 5,123,708

DATED : June 23, 1992

INVENTOR(S) : Toshio Akesaka

It is certified that error appears in the above-identified patent and that said Letters Patent is hereby corrected as shown below:

Column 1, line 12, change "Disclosure" to --Disclosures--.

Column 2, line 57, change "t" to --to--.

Column 5, line 20, after "portion" insert --14a and a front end of second tubular portion--.

Signed and Sealed this

Twenty-third Day of November, 1993

*Attest:*

*Attesting Officer*

Bruce Lehman

BRUCE LEHMAN

*Commissioner of Patents and Trademarks*